United States Patent [19]

Prisco et al.

[11] Patent Number: 4,679,738

[45] Date of Patent: Jul. 14, 1987

[54] CONVEYOR FOR SORTING RADIOACTIVE WASTE

[75] Inventors: Anthony J. Prisco, Beverly; Alfred N. Johnson, Voorhees, both of N.J.

[73] Assignee: Westinghouse Electric Corp., Pittsburgh, Pa.

[21] Appl. No.: 648,833

[22] Filed: Sep. 10, 1984

[51] Int. Cl.[4] ..... B02C 23/08

[52] U.S. Cl. ..... 241/101.2; 198/860.4; 209/589; 241/DIG. 38; 241/68

[58] Field of Search ..... 241/68, 79.1, 101.2, 241/101.3, 101.5, DIG. 38; 209/576, 589; 198/860.4, 860.5

[56] References Cited

U.S. PATENT DOCUMENTS

| | | | |
|---|---|---|---|
| 1,575,717 | 3/1926 | Plauson | 241/DIG. 14 X |
| 2,617,526 | 11/1952 | LaPointe | 209/72 |
| 2,717,693 | 9/1955 | Holmes | 209/72 |
| 3,052,353 | 9/1962 | Pritchett | 209/111.5 |
| 3,259,744 | 7/1966 | Gorecki et al. | 250/71.5 |
| 3,557,685 | 1/1971 | Schroering | 241/68 X |
| 3,768,645 | 10/1973 | Conway et al. | 209/111.5 |
| 3,790,091 | 2/1974 | Law et al. | 241/68 X |
| 3,802,631 | 4/1974 | Boyd | 241/68 X |
| 4,143,769 | 5/1979 | Ripple . | |
| 4,170,293 | 10/1979 | Campbell | 198/860.4 |
| 4,194,634 | 3/1980 | Kelly | 209/589 |
| 4,275,298 | 6/1981 | Wykes et al. | 250/255 |
| 4,365,719 | 12/1982 | Kelly | 209/589 |

FOREIGN PATENT DOCUMENTS

| | | | |
|---|---|---|---|
| 3304850 | 8/1984 | Fed. Rep. of Germany | 241/79.1 |
| 58-139090 | 8/1983 | Japan . | |
| 112165 | 1/1968 | Norway | 209/576 |
| 2019338 | 10/1979 | United Kingdom . | |
| 888013 | 12/1981 | U.S.S.R. | 241/68 |

*Primary Examiner*—Mark Rosenbaum
*Assistant Examiner*—Joseph M. Gorski

[57] ABSTRACT

This invention relates to an apparatus for sorting radioactive waste. The apparatus comprises structure for reducing the waste to pieces of substantially uniform size and first and second radiation detecting structure. Structure is provided for conveying the pieces from the reducing structure to the first and second radiation detecting structure. Structure is provided for dispersing the pieces of waste between the first and second detecting structure so that the pieces which are collected together in clusters can separate from each other to thereby increase the likelihood of detecting radiation emanating from the pieces.

17 Claims, 8 Drawing Figures

CONVEYOR FOR SORTING RADIOACTIVE WASTE

BACKGROUND OF THE INVENTION

This invention relates to an apparatus and method for sorting waste which comprises materials having a low level of radioactivity.

Waste having low levels of radioactivity is created at nuclear power plants and similar facilities. Typically, waste comprises paper, fabrics, boots, clothing, tools and other items which can normally be expected to be used in the laboratories, offices, workshops and the like of a nuclear facility. Prior to its disposal the waste is taken through a series of inspections during which it is inspected for beta particle and gamma ray emissions.

To the extent that radioactive emissions above predetermined levels are detected, the waste is disposed of as hazardous by being buried at controlled disposal sites. Usually radiation in excess of 2 milliroentgens per hour is considered to be hazardous.

Waste which exhibits radiation which is less than 2 milliroentgens per hour is subjected to closer inspection in an attempt to remove its nonradioactive components so that they can be reused where appropriate or treated as ordinary non-hazardous waste. This reduces the volume of materials that must be buried at controlled sites and provides an opportunity to recover valuable items.

An aspect of inspecting waste relates to an inspection for low level beta particle emission and low level gamma ray emission. This is because a failure to detect and remove articles that are contaminated with low level radiation emitters could result in injury to persons who are exposed to the radiation over a long period of time. In order to minimize the radiation hazard to persons who are using the conveyor and apparatus of the present invention, the waste is given a preliminary examination so that items exhibiting relatively high levels of radioactivity, i.e., over 2 milliroentgens per hour are removed. Further means can be provided for subsequent examination of articles even if only very low levels of radiation are detected in order to assure that all contaminated articles are removed.

A process for the preliminary examination of radioactive waste of which the method and apparatus disclosed herein can be a part is disclosed in co-pending patent application Ser. No. 648,780 entitled METHOD FOR SORTING RADIOACTIVE WASTE which was filed by Alfred N. Johnson and Anthony J. Prisco on Sept. 10, 1984, and co-pending patent application Ser. No. 648,778 entitled METHOD AND APPARATUS FOR DETECTING RADIATION IN A CONTAINER which was filed by Alfred N. Johnson and Anthony J. Prisco on Sept. 10, 1984.

The apparatus disclosed herein is operative to provide a safe environment for technicians as waste which has been preliminarily sorted by the apparatus disclosed in U.S. Pat. No. 4,599,513, entitled ENCLOSURE FOR SORTING RADIOACTIVE MATERIAL is subjected to further examination in an attempt to locate articles which emit radioactivity and which have escaped detection in the aforementioned enclosure.

Figure 1:
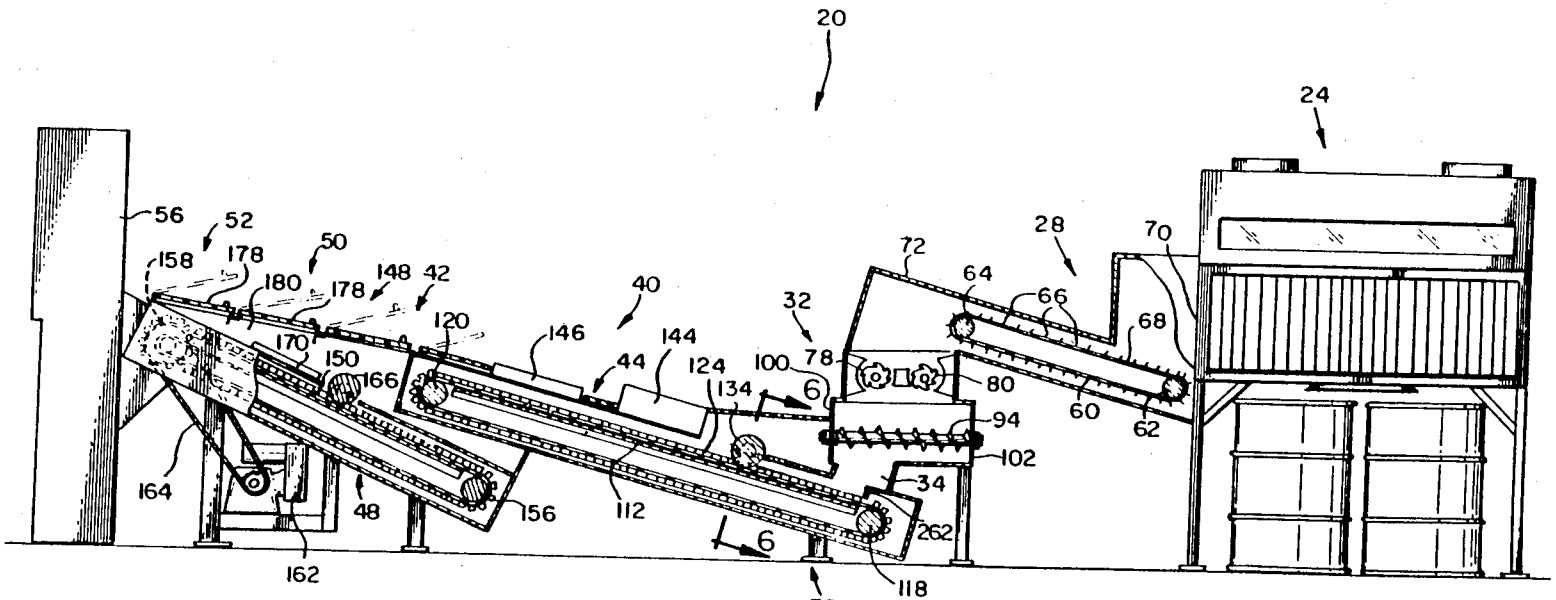
FIG. 1 is a side elevation view, partially in section of the apparatus comprising the invention.

Now referring to the drawings for a detailed description of the preferred embodiment of the invention, a conveyor system 20 illustrated in FIG. 1 is shown connected to a sorting table 24 of the type disclosed in detail in the aforementioned U.S. Pat. Ser. No. 4,599,513, which was executed by Alfred N. Johnson and Anthony J. Prisco on Aug. 24, 1984. Waste which has been found to be nonradioactive is removed from the sorting table 24 and placed in the conveyor system 20. The conveyor system 20 includes a transfer means such as conveyor 28. The waste on conveyor 28 is moved by way of that conveyor to a housing 32 which contains a means for reducing the waste to pieces of uniform size as by shredding it for example. Waste which is discharged from housing 32 is reduced to pieces of relatively small size, typically only about two to four square inches in area. The reduced waste is deposited on the receiving portion 38 of a conveyor 40. Conveyor 40 may be disposed at an angle of about 15 to 20 degrees from the horizontal so that its receiving portion 38 is lower than its discharge portion 42. Discharge portion 42 is above and upstream from the receiving portion 48 of a conveyor 50 which is disposed at an angle of about 20 to 25 degrees from the horizontal so that its discharge portion 52 is higher than its receiving portion and is in alignment with the opening in a compactor 56. Thus, reduced waste which is discharged from discharge portion 42 falls onto receiving portion 48.

Since both conveyors 40 and 50 are disposed at angles to the horizontal, the discharge portion 42 of conveyor 40 overlies the receiving portion 48 of conveyor 50 so that material which is in clusters when it falls off discharge portion 42 tends to disperse as it strikes receiving portion 48 of conveyor 50.

As best seen in FIG. 1 conveyor 28 may comprise a belt 60 made of a flexible resilient material such as rubberized fabric which is wrapped around end rollers 62 and 64. The belt comprises a plurality of laterally extending ribs 66 which tend to prevent material from sliding along the belt. To this extent, the top surface 68 of the belt is in general alignment with an opening 70 in the end of the sorting table 24 so that materials in the sorting table 24 can be dispersed through opening 70 onto the belt. The belt may be angled so that it slopes upwardly to discharge waste into housing 32. Preferably, the belt 60 is disposed within a housing 72 which is connected sorting table 24.

Figure 4:
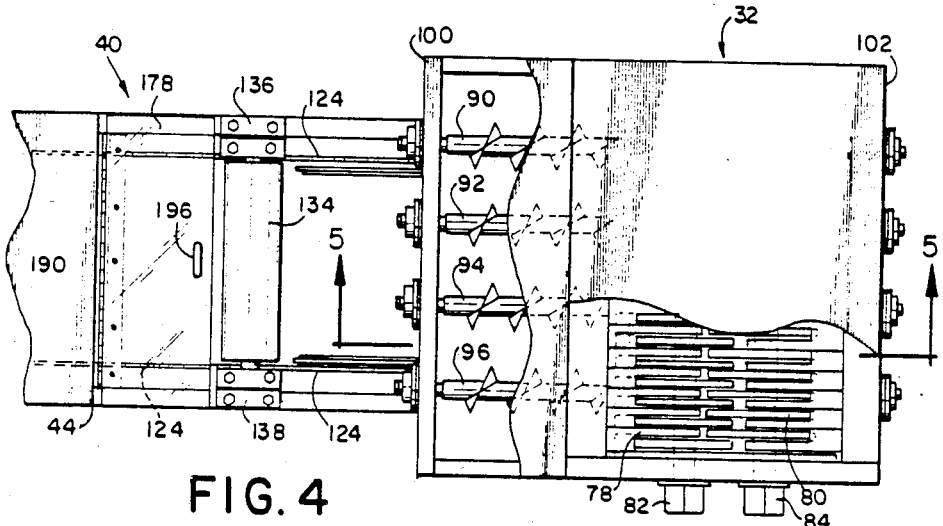
FIG. 4 is a plan view, partially in section of a portion of FIG. 1.
Figure 5:
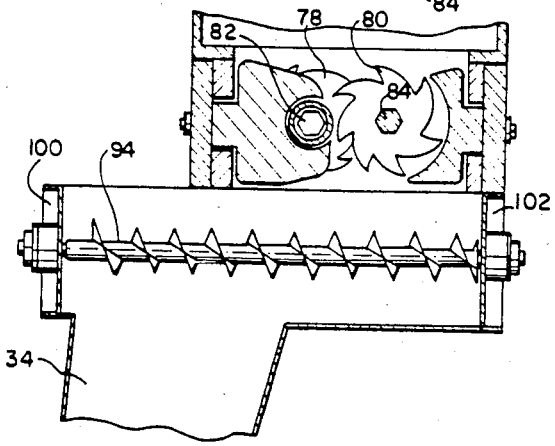
FIG. 5 is a section view taken along line 5—5 of FIG. 4.

As seen in FIGS. 4 and 5 housing 32 contains a plurality of counterrotating toothed wheels 78 and 80 which are mounted on shafts 82 and 84. Preferably each of wheels 78 and 80 comprise a plurality of cutting points. The teeth grasp the waste as it is dropped into housing 32 from conveyor 28 and reduce it by shredding to pieces of substantially uniform size. The shredded pieces discharged by wheels 78 and 80 are engaged by horizontally disposed augers 90, 92, 94 and 96 which are journaled in front and rear walls 100 and 102 of the lower portion of housing 32.

Figure 6:
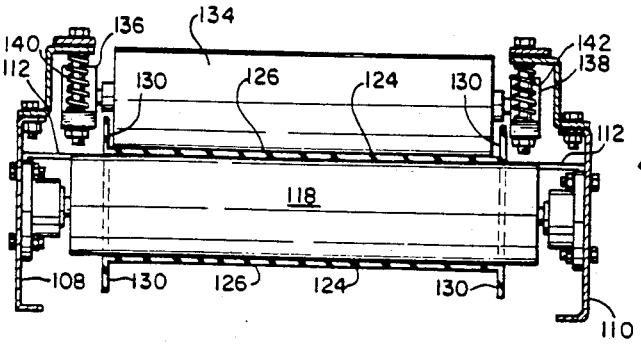
FIG. 6 is a section view taken along line 6—6 of FIG. 1.
Figure 7:
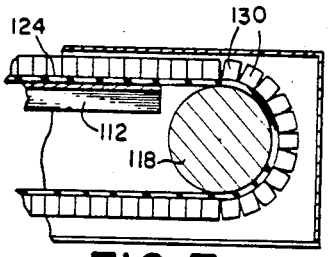
FIG. 7 is a detail, partially in section of a portion of FIG. 1.

The augers move the reduced material forward and discharge it from housing 32 by way of duct 34 onto the receiving portion 38 of conveyor 40. Conveyor 40 is contained within a housing 44 which comprises, as best seen in FIG. 6, sidewalls 108 and 110 and a transverse wall 112. The transverse wall 112 is joined to the sidewalls 108 and 110. The sidewalls support end rollers 118 and 120 over which is supported an elongated belt 124 comprised of a rubberized fabric or other suitable resilient and flexible material. As best seen in FIGS. 6 and 7 the belt 124 comprises an horizontally disposed, elongated web 126 which supports, at its lateral edges, a plurality of upwardly directed flange sections 130 which are operative to prevent the waste from falling off the sides of belt 124. A plurality of discrete flange sections 130 is particularly desirable since, as seen in FIG. 7 they tend to separate from each other to enable the belt to pass around the end rollers 118 and 120 while at the same time remaining as sidewalls to prevent material from falling off the sides of the belt 124. The upper flight of belt 124 is supported by transverse wall 112 so that it is not deformed by the material that it conveys.

As best seen in FIGS. 1, 4 and 6 the conveyor 40 includes a roller 134 for leveling and flattening the reduced pieces of waste to a substantially uniform height. Roller 134 may be comprised of a suitable material such as steel or the like. The roller 134 is journaled in brackets 136 and 138 which are connected to the sidewalls 108 and 110 of the conveyor housing 44. The brackets 136 and 138 may include suitable means for urging roller 134 into engagement with the upper surface of the web 126 such as the helical compression springs 140 and 142.

The side walls 108 and 110 of conveyor housing 44 support suitable means for detecting gamma ray and beta particle contamination 144 and 146 which is in excess of predetermined levels.

The gamma ray detector may comprise a scintillation detector 144 of a type which is well-known in the art. The scintillation detector is arranged so that it energizes an alarm if contamination in excess of predetermined gamma radiation are detected.

The beta particle detector 146 is typically a gas proportional detector of a type which is also well-known in the art. It may be arranged to energize an alarm when it detects beta contamination in excess of a predetermined level.

The gamma ray detector 144 and beta particle detector 146 are both supported on the side walls 108 and 110 of the conveyor housing 42 with their detectors facing down and in relatively close proximity to web 126 of belt 124 so that rays and particles emitted from pieces of waste on the belt can be readily detected.

When beta particle or gamma ray levels in excess of the predetermined levels are detected by detectors 144 or 146, the conveyor can be stopped and the contaminated particles removed by suitable means such as vacuum or the like.

If no beta particles or gamma rays are detected the pieces of waste fall off the discharge portion 42 of conveyor 40 and are received by the receiving portion 48 of conveyor 50. In the course of their fall, the pieces of waste are redistributed and/or overturned in a random fashion.

Conveyor 50 comprises a housing 148. It includes a belt 150 which is made of the same material as belt 124 and has the same configuration to the extent that it includes a web and upwardly extending flange sections on the lateral edges thereof. Belt 150 is wrapped around end rollers 156 and 158. A motor 162 is connected to end roller 158 by a suitable drive chain 164 to drive conveyor 50. End roller 156 on conveyor 50 can also be connected by a suitable drive chain (not shown) to end roller 120 on conveyor 40 so that both conveyors can be driven by motor 162. By suitable gearing arrangements, conveyor 50 can be driven at a speed which is somewhat greater than conveyor 40 so that the pieces of material which are discharged from conveyor 40 will be spread along conveyor 50. In the alternative both conveyors may be driven at the same speed or conveyor 50 may be driven at a slower rate than conveyor 40. It is preferrd that both conveyors be driven at the same speed to maximize the efficiency of detecting radiation. However, special applications may require that the conveyors be driven at different speeds.

The sidewalls of conveyor 50 support a roller 166 by structure which is the same as that illustrated in FIG. 6.

Conveyor 50 also includes a gas proportional detector 170 for detecting beta particle contamination down stream of the leveling roller 166.

The gas proportional detector is arranged to energize an alarm if contamination in excess of predetermined beta contamination levels is detected.

This is duplicative to some extent of beta particle detectors 146. However, it serves as a reinforcement of the reliability of the first detector. Further, since the pieces of waste have been permitted to fall in a random fashion from conveyor 40 to conveyor 50 and are dispersed, the different random arrangement of the pieces on conveyor 50 increases the liklihood of detecting beta comtamination which was not detected by detector 146.

Thus, the low penetrating ability of the beta particles is offset by two detectors 144 and 170, and two leveling rollers 134 and 166 and the arrangement of the discharge portion 42 of conveyor 40 spaced above the receiving portion 48 of conveyor 50.

The housings 44 and 148 for conveyors 40 and 50 and their connections to each other and to the compactor 56 and the housing 32 provide a generally closed air conduit. Consequently, when air is evacuated from the sorting table as more fully explained in aforementioned U.S. Pat. No. 4,599,513, the apparatus is at a negative pressure so that radioactive contaminated particles entrained in the air cannot escape.

The housing 148 comprises the bottom wall 174 of the conveyor 50 and its sidewalls.

Figure 3:
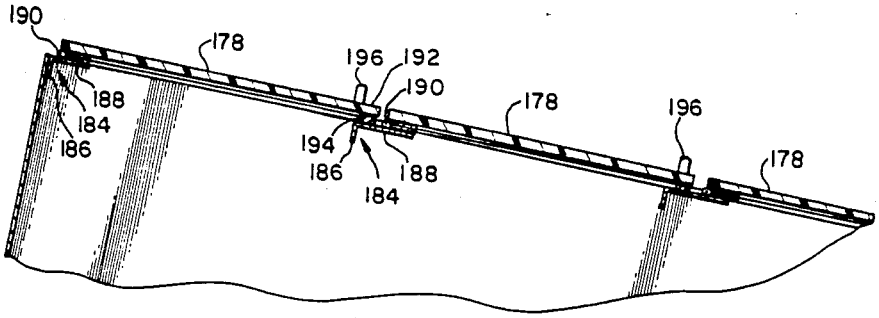
FIG. 3 is a side elevation view, partially in section of a detail of FIG. 1.
Figure 8:
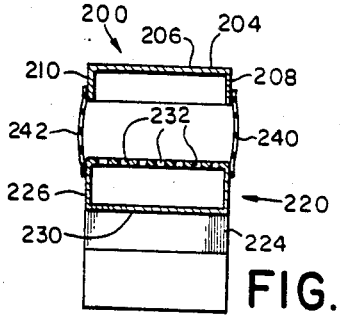
FIG. 8 is a section view taken along line 8—8 of FIG. 2.

Suitable coverings are provided for conveyor housings 44 and 148 which enable the operator of the apparatus to observe the material moving along the conveyors and to obtain access to the waste thereon for removal of contaminated items. The means may comprise a plurality of members 178 which are supported on the sidewalls of conveyor housings 44 and 148. As best seen in FIGS. 3 and 4 the members 178 may be comprised of a suitable heavy clear plastic material such as polycarbonate. They may be mounted directly on the sidewalls 108 and 110 of conveyor housing 44. They are supported on upwardly extending heavy clear plastic sidewalls 180 which are supported on the sidewalls of the conveyor housing 44 and 148 so that the end to end succession of members 178 forms a continuous cover for the conveyors 40 and 50.

As best seen in FIGS. 1 and 3 the sidewalls of either housing 44 or 148 support horizontally extending transversely directed brackets 184 which may comprise a vertical element 186 and a horizontal element 188. A hinge 190 is connected between the horizontal elements 188 and the members 178 so that members 178 can be pivoted about the hinges to provide access to the conveyors.

Each of the members 178 may be generally rectangular in comfiguration with its distal end 192 resting on a horizontally extending pad 194 which is supported on the horizontal element 188 of the next adjacent bracket 184. The pad 194 may be made of a suitable material such as rubber, neoprene or the like so that it comes into contact with the distal ends 192 of members 178 to preserve the generally closed nature of the system. Each of the members 178 includes a handle 196 by which it can be readily raised from pad 194 to permit access to the material on the transfer means.

Figure 2:
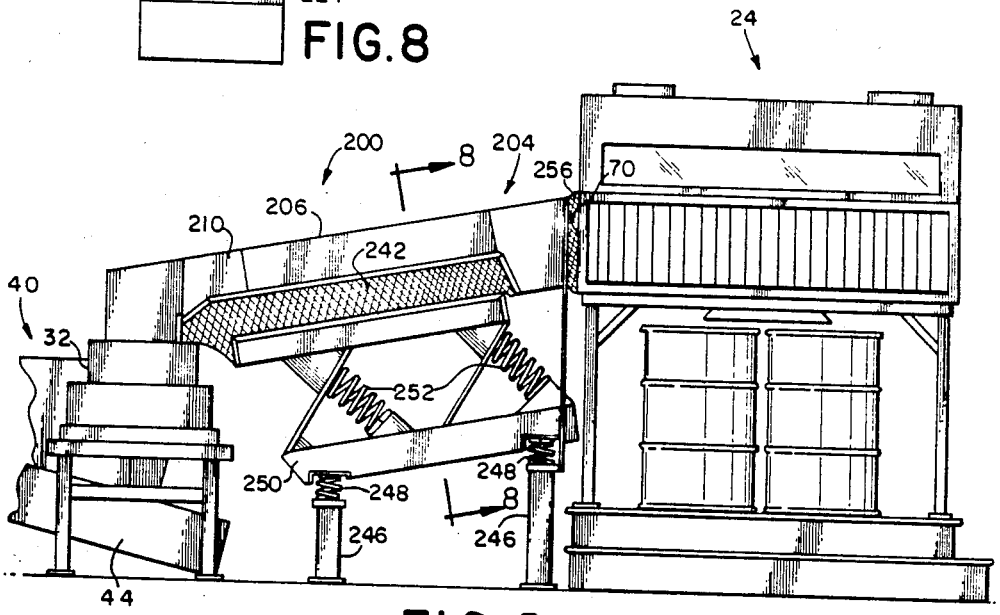
FIG. 2 is a side elevation view, partially in section of a modified form of the apparatus.

In FIG. 2 an alternate embodiment of transfer means 28 is illustrated. The conveyor which is identified generally by the reference numeral 200 is a vibrating conveyor of a well-known type. The conveyor comprises a housing 204 which includes a top-wall 206 and two downwardly extending sidewalls 208 and 210. The conveyor also includes a vibrating portion 220 which includes a perforated conveying surface 222 which is supported by sidewalls 224 and 226. The sidewalls are connected at their lower ends to bottom wall 230. Openings 232 in perforated conveying surface 222 are large enough so that heavy small objects such as nuts, bolts, screws and the like can fall through the openings and be collected on bottom wall 230. Sidewalls 208 and 224 and 210 and 226 are connected to each other by sheets of rubberized fabric 240 and 242 so that vibrating portion 220 can move independently of housing 204 while remaining generally closed.

The conveyor 200 is supported on legs 246. The legs are connected by spring couplings 248 to a shaker platform 250. The shaker platform 250 includes means for inducing vibration into the platform in a well-known fashion. The vibrations of the platform are transmitted to the vibrating portion 220 of the conveyor by means of helical compression springs 252 which are connected between them.

The housing 204 is connected at one end to the aforementioned housing 32. At its other end it is connected by a tube of rubberized fabric 256 or other suitable material to the opening in the end of sorting table 24.

To operate the system, the motor 162 is energized to drive conveyors 40 and 50. Wheels 78 and 80 and augers 90, 92, 94 and 96 are energized as is conveyor 28. If vibrating conveyor 200 is used, the vibrating portion 220 of that conveyor is energized. Waste is placed on the conveyors 28 or 200 as the case may be while air is evacuated from the system. The evacuation of air is possible since the housings are in generally end-to-end substantially air tight relation to each other. The waste, which may be paper, fabric and the like, in random sizes and shapes is moved by the conveyors 60 and 200 to the housing 32.

The material then falls into the counter-rotating wheels 78, 80 which reduces material by shredding it into pieces of generally uniform small size, on the order of about one or two square inches, and discharges it into the augers 90, 92, 94 and 96. The shredded material is then moved forward by the augers and falls onto receiving portion 38 of conveyor 40. A wall 262 supported between the sidewalls of the housing 44 extends almost to the surface of belt 124 to prevent material from falling off the receiving portion of conveyor 40. The conveyor moves the reduced waste under the roller 134 where it is substantially reduced in height and then under the detectors 138 and 140 where beta particle and gamma ray emission can be detected. Upon the energization of the alarm, the conveyors can be stopped, one of the members 178 opened and the waste in the region of the detector removed for disposal as being contaminated.

After reaching the discharge portion of conveyor 40, the material falls off that conveyor onto the receiving portion 48 of conveyor 50.

While on conveyor 50, the pieces pass under leveling roller 166 and pass under beta particle detector 170 in order to detect radiation which may have been missed by detector 140. Discharge of material from the discharge portion 52 of the conveyor 50 is into compactor 56.

The compactor may be of any convenient type which is adapted to reduce the volume of material which is received therein.

In this regard, a box, plastic bag or other suitable container may be stored in compactor 56 for the purpose of receiving material which is discharged from conveyor 50. The compactor is operative to maximize the amount of material that can be placed in the bag or box in a well-known manner. Since the material which is collected in the compactor has now been determined to be free of material which emits radioactivity, the boxes or bags can now be disposed of as ordinary trash. On the other hand, if further investigation of the level of radioactivity, if any, emanating from the box is desired, the box can be placed in a detector which is capable of detecting gamma rays which are emitted at a very low level. A suitable device for doing this is disclosed in the above-mentioned co-pending patent application Ser. No. 648,778 which was executed by Alfred N. Johnson and Anthony J. Prisco on Sept. 10, 1984 and which is entitled METHOD AND APPARATUS FOR DETECTING RADIATION IN A CONTAINER.

Thus, while the invention has been described with respect to certain forms and embodiments thereof, it is apparent that other forms and embodiments will be obvious to those skilled in the art by the foregoing description and drawings. Thus, the scope of the invention should not be limited by the foregoing description but, rather, only by the scope of the claims appended hereto.

We claim:

1. An apparatus for detecting radioactive components in dry active waste, said apparatus comprising, means for reducing the waste to pieces of substantially uniform size, first and second conveyors and a housing for said conveyors, means for conveying said pieces from said means for reducing the waste to said first and second conveyors, each of said first and second conveyors including a receiving portion and a discharge portion, said discharge portion of said first conveyor being spaced above and upstream from said receiving portion of said second conveyor to disperse said pieces as they are transferred from said first conveyor to said second conveyor so that said pieces which are in clusters are separated from each other to increase the likelihood of detecting radiation emanating therefrom, a plurality of radiation detector means for detecting radioactive radiation emanating from said pieces, at least one of said plurality of radiation detector means being located on each of said conveyors, each of said radiation detector means being disposed in close overlying relation to its respective conveyor so that low levels of radiation emanating from said pieces can be detected, each of said conveyors including means for flattening said pieces of waste before said pieces pass under said radiation detector means, and said means for flattening being disposed between said receiving portion of each conveyor and said radiation detector means on each of said conveyors, said housing being generally closed, and means for providing a generally closed connection between said housing and said means for reducing the waste so that air that is in said housing and in said means for reducing the waste can be controlled.

2. An apparatus as defined in claim 1 including a plurality of apertures in said housing to provide access to said conveyors, and means for closing said apertures.

3. An apparatus as defined in claim 1 including means for evacuating air from said housing.

4. An apparatus as defined in claim 1 wherein said means for flattening said pieces of waste comprise rollers, supporting means on each of said conveyors, and each of said rollers is supported by one of said supporting means.

5. An apparatus as defined in claim 1 wherein each of said supporting means comprises facing brackets supported on each of said conveyors, and said brackets comprise bearing surfaces in which said rollers are journaled.

6. An apparatus as defined in claim 5 including means for urging said rollers into engagement with said conveyor.

7. An apparatus as defined in claim 1 including means for driving said conveyors in the same direction.

8. An apparatus as defined in claim 1 including means for driving said conveyors in the same direction and at the same speed.

9. An apparatus as defined in claim 1 including means for driving said second conveyor at a faster speed than that of said first conveyor.

10. An apparatus as defined in claim 1 wherein the receiving portion of said second conveyor is lower than its discharge portion to assist the dispersing of said pieces.

11. An apparatus as defined in claim 1 including other means for conveying, said other means including a receiving portion and a discharge portion, said discharge portion being connected to said means for reducing the waste.

12. An apparatus as defined in claim 1 including means for driving said second conveyor at a slower speed than that of said first conveyor.

13. An apparatus as defined in claim 1 wherein said housing comprises side walls and a cover, said side walls being disposed on opposite sides of said conveyors and said cover comprising a plurality of juxtaposed members which are connected to said side walls, at least some of said plurality of juxtaposed members being pivotally connected to said side walls for movement between a first position where they lie on said side walls to close said housing and a second position where they provide access to said conveyors.

14. An apparatus as defined in claim 1 wherein each of said first and second conveyors includes a conveying surface comprising a web with first and second laterally positioned and upwardly directed flange sections extending therefrom to prevent said pieces from falling off said surface.

15. An apparatus as defined in claim 1 wherein each of said first and second conveyors includes a conveying surface comprising a web with first and second laterally positioned and upwardly directed flange sections extending therefrom to prevent said pieces from falling off said surface.

16. An apparatus as defined in claim 15 wherein each conveying surface includes two lateral edges, and said flange sections are in side by side relation along said lateral edges so that they form a continuous flange when said conveyor is flat.

17. An apparatus as defined in claim 1 including means for driving said second conveyor at a slower speed than that of said first conveyor.

* * * * *

UNITED STATES PATENT AND TRADEMARK OFFICE

CERTIFICATE OF CORRECTION

PATENT NO. : 4,679,738

DATED : July 14, 1987

INVENTOR(S) : Anthony J. Prisco et al

It is certified that error appears in the above-identified patent and that said Letters Patent is hereby corrected as shown below:

Cancel claims 15 and 17.

Renumber claim 16 to depend from claim 14.

Signed and Sealed this

Twenty-second Day of November, 1988

*Attest:*

DONALD J. QUIGG

*Attesting Officer*

*Commissioner of Patents and Trademarks*